US006664881B1

(12) United States Patent
Thompson et al.

(10) Patent No.: US 6,664,881 B1
(45) Date of Patent: Dec. 16, 2003

(54) EFFICIENT, LOW LEAKAGE INDUCTANCE, MULTI-TAP, RF TRANSFORMER AND METHOD OF MAKING SAME

(75) Inventors: Leslie L. Thompson, Honeoye Falls, NY (US); Francisco Chiarilli, Spencerport, NY (US)

(73) Assignee: Ameritherm, Inc., Scottsville, NY (US)

( * ) Notice: Subject to any disclaimer, the term of this patent is extended or adjusted under 35 U.S.C. 154(b) by 337 days.

(21) Appl. No.: 09/589,656

(22) Filed: Jun. 8, 2000

Related U.S. Application Data

(60) Provisional application No. 60/168,073, filed on Nov. 30, 1999.

(51) Int. Cl.[7] ..... H01F 5/00

(52) U.S. Cl. ..... 336/200; 336/232; 336/145; 336/147; 336/148

(58) Field of Search ..... 336/200, 223, 336/232, 199, 185, 147, 146, 145, 148, 83, 183

(56) References Cited

U.S. PATENT DOCUMENTS

| | | | | |
|---|---|---|---|---|
| 3,083,331 | A | | 3/1963 | Spurway |
| 3,617,967 | A | | 11/1971 | Mitrach |
| 3,691,495 | A | | 9/1972 | Conway |
| 3,706,060 | A | | 12/1972 | Goodman |
| 3,845,437 | A | | 10/1974 | Goodman |
| 3,895,335 | A | | 7/1975 | Manimalethu |
| 4,092,621 | A | | 5/1978 | Nyswander et al. |
| 4,160,224 | A | | 7/1979 | Owen |
| 4,255,734 | A | | 3/1981 | Owen |
| 4,256,932 | A | | 3/1981 | Owen |
| 4,300,112 | A | | 11/1981 | Leibinger et al. |
| 4,325,020 | A | | 4/1982 | Wein |
| 4,524,341 | A | | 6/1985 | Owen |
| 4,532,483 | A | | 7/1985 | Schminke |
| 4,533,892 | A | | 8/1985 | Masuhara et al. |
| 4,547,721 | A | | 10/1985 | Drapp |
| 4,611,190 | A | | 9/1986 | Montague |
| 4,678,986 | A | | 7/1987 | Barthelemy |
| 4,837,497 | A | | 6/1989 | Leibovich |
| 4,868,533 | A | | 9/1989 | Ehrenhalt et al. |
| 5,570,074 | A | * | 10/1996 | Steigerwald et al. ..... 336/83 |
| 5,719,544 | A | | 2/1998 | Vinciarelli et al. |

FOREIGN PATENT DOCUMENTS

EP 0 481 755 A2 * 4/1992

OTHER PUBLICATIONS

Product Selection Guide—1997—Magnetic Products, Philips Magnetic Products, Edition Nov. 1996, 3 pages.

* cited by examiner

*Primary Examiner*—Tuyen T. Nguyen
(74) *Attorney, Agent, or Firm*—Rothwell, Figg, Ernst & Manbeck

(57) ABSTRACT

A low leakage inductance, versatile RF transformer with multiple input/output voltage ratios. The transformer has many applications. For example, and not by way of limitation, the transformer can be used with switching power supplies, RF induction power supplies, and RF plasma power supplies. The efficiency of the transformer is on the order of 99% to 99.7%. These efficiencies have been measured at power levels of 3 kilowatts (KW) to 10 KW.

20 Claims, 11 Drawing Sheets

"Prior Art"

1100
1102(1)
1102(2)
1102(3)
1102(4)
1104(1)
1104(2)
1104(3)
1104(4)
1106
1108(1)
1108(2)
1108(3)
1108(4)
1108(5)
1108(6)
1108(7)
1108(8)
1108(9)
1108(10)
1108(11)
1108(12)
1108(13)
1108(14)
1108(15)
1108(16)
1108(17)
1108(18)
1108(19)
1108(20)
1108(21)
1108(22)
1108(23)
1108(24)
1108(25)
1108(26)
1108(27)
1108(28)
1108(29)
1108(30)
1108(31)
1108(32)
1108(33)
1108(34)
1108(35)
1108(36)
1108(37)
1108(38)
1108(39)
1108(40)

EFFICIENT, LOW LEAKAGE INDUCTANCE, MULTI-TAP, RF TRANSFORMER AND METHOD OF MAKING SAME

CROSS-REFERENCE TO RELATED APPLICATIONS

This application claims the benefit of U.S. Provisional Application Ser. No. 60/168,073, filed Nov. 30, 1999, which is incorporated herein by reference in its entirety.

BACKGROUND OF THE INVENTION

1. Field of the Invention

The present invention is generally related to transformers, and more specifically, to an efficient, low leakage inductance, multi-tap, RF transformer.

2. Discussion of the Background

A transformer is a device that transfers electrical energy from one circuit to one or more other circuits, either increasing (stepping up) or decreasing (stepping down) a voltage. A transformer transfers energy through the process of electromagnetic induction.

A conventional transformer includes a first coil (the primary winding) and a second coil (the secondary winding). The primary winding and the secondary winding of a transformer are placed in close proximity to each other so that when a varying flux is produced in the primary winding the varying flux passes through the secondary winding. A varying flux can be produced in the primary winding by applying a varying voltage to the primary winding. As a result of the varying flux passing though the secondary winding, a voltage will be developed across the secondary winding through the process of electromagnetic induction. In this manner, voltage is transferred from the primary winding to the secondary winding.

FIG. 1 is an illustration of an ideal transformer 100. As shown in FIG. 1, transformer 100 includes a first coil 101 and a second coil 102. The first coil 101 is placed in close proximity to the second coil 102. The first coil 101 will be referred to as the primary winding 101 and the second coil 102 will be referred to as the secondary winding 102. Because transformer 100 is an ideal transformer (that is, it is 100% efficient), the relationship between the varying voltage developed across the secondary winding ($V_s$) and the varying voltage applied to the primary winding ($V_p$) is: $V_s=N_s/N_p\ (V_p)$, where $N_s$ is the number of turns in the secondary winding 102 and $N_p$ is the number of turns in the primary winding 101.

Unfortunately, unlike ideal transformers, realizable transformers are not 100% efficient. Realizable transformers have a characteristic called "leakage inductance," which generally appears to be in series with the primary winding. The greater the leakage inductance of a transformer, the lower the transformer's efficiency. Consequently, in applications where high efficiency is demanded, the goal of the transformer designer is to reduce the leakage inductance as far as possible. However, the designs that have been developed to overcome the leakage inductance problem are difficult to manufacture, not versatile, and/or not able to transform energy efficiently over a wide range of frequencies.

Therefore, what is desired is an efficient, versatile, low leakage inductance transformer that is easy and inexpensive to manufacture.

SUMMARY OF THE INVENTION

The present invention provides a low leakage inductance, versatile RF transformer with multiple input/output voltage ratios.

In one aspect, a transformer according to one embodiment includes a stack of conductors that has been shaped into the form of coil. A first group of the conductors form the primary winding of the transformer and the remaining conductors form the secondary winding. Preferably, to minimize leakage inductance, the group of conductors that forms the primary winding is interleaved with the group of conductors that forms the secondary winding.

A printed circuit board (PCB) is used to connect the conductors. More specifically, the PCB has a first set of plated slots and traces that are used to interconnect the conductors that form the primary winding, and the PCB has a second set of plated slots and traces that are used to interconnect the conductors that form the secondary winding. In one embodiment, the first set of traces connect in series the conductors that form the primary winding, and the second set of traces connect in series the conductors that form the secondary winding.

Advantageously, the PCB also has a number of input and output terminals (also referred to as thru-holes). The input terminals are connected to the primary winding and the output terminals are connected to the secondary winding.

In another aspect, the present invention provides an auto-transformer. The auto-transformer includes a plurality of conductors stacked on top of each other and formed into the shape of a coil. The auto-transformer also includes a PCB having a plurality of slots and a plurality of traces for electrically connecting the conductors. In one embodiment, the plurality of traces connect the conductors in series. There are also provided a number of input terminals and output terminals so that the user of the auto-transformer can select one from among many possible voltage ratios.

Further features and advantages of the present invention, as well as the structure and operation of various embodiments of the present invention, are described in detail below with reference to the accompanying drawings.

BRIEF DESCRIPTION OF THE DRAWINGS

The accompanying drawings, which are incorporated herein and form part of the specification, illustrate various embodiments of the present invention and, together with the description, further serve to explain the principles of the invention and to enable a person skilled in the pertinent art to make and use the invention. In the drawings, like reference numbers indicate identical or functionally similar elements. Additionally, the left-most digit(s) of a reference number identifies the drawing in which the reference number first appears.

DETAILED DESCRIPTION OF THE PREFERRED EMBODIMENTS

Figure 1:
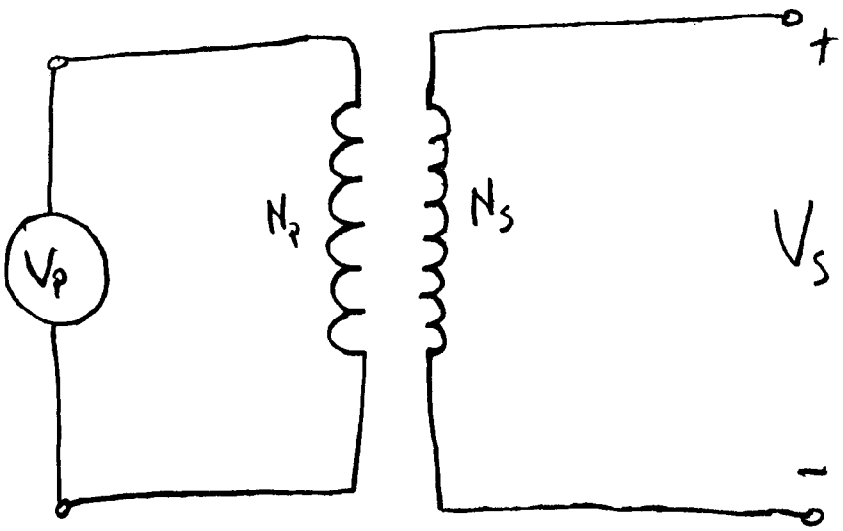
FIG. 1 is an illustration of an ideal transformer.
Figure 2:
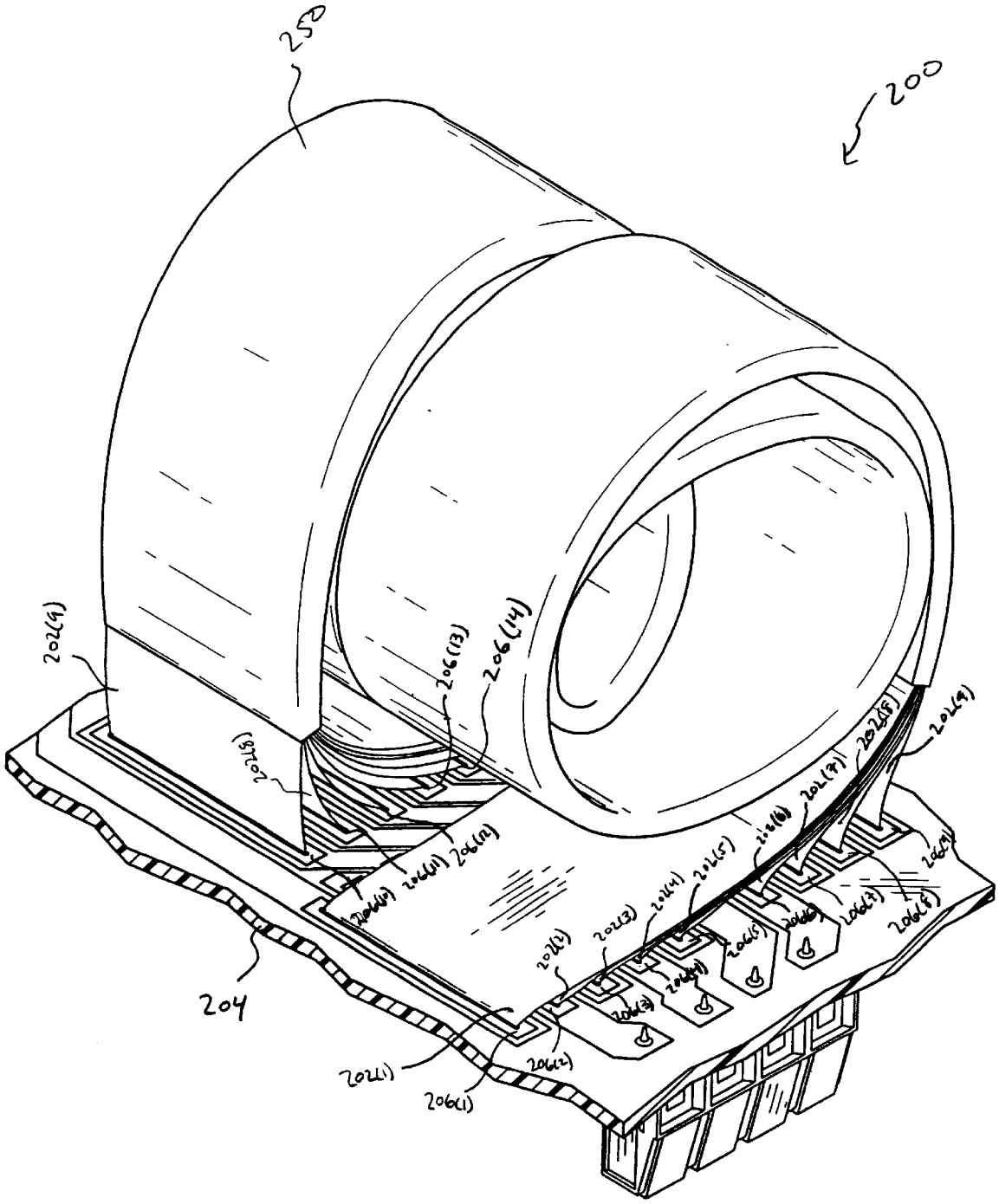
FIG. 2 is a perspective view of a transformer according to one embodiment of the present invention.

FIG. 2 illustrates a transformer 200 according to one embodiment of the present invention. Transformer 200 is a low leakage inductance, versatile RF transformer with multiple input/output voltage ratios. Transformer 200 has many applications. For example, and not by way of limitation, transformer 200 can be used with switching power supplies, RF induction power supplies, and RF plasma power supplies. The efficiency of transformer 200 is on the order of 99% to 99.7%. These efficiencies have been measured at power levels of 3 kilowatts (KW) to 10 KW.

As shown in FIG. 2, transformer 200 includes a stack of nine conductors 202(1)–(9). However, the invention is not limited to any particular number of conductors 202. The conductors 202 have been stacked on top of each other and wound around an axis to form a coil 250. Each conductor 202 has two ends, and each end of each conductor 202 has been inserted into a plated slot 206 of a printed circuit board (PCB) 204. Slots 206(1)–(14) are shown in FIG. 2. PCB 204 functions to form electrical connections between conductors 202.

In a preferred embodiment, conductors 202 are made from thin strips of copper foil. Preferably, the width of the foil is about 1.5 inches, and the dimension of the slots 206 are 1/16 inch by about 1.5 inch, however, other dimensions are contemplated. In an alternative embodiment, Litz wire can be used as the conductors.

Figure 3:
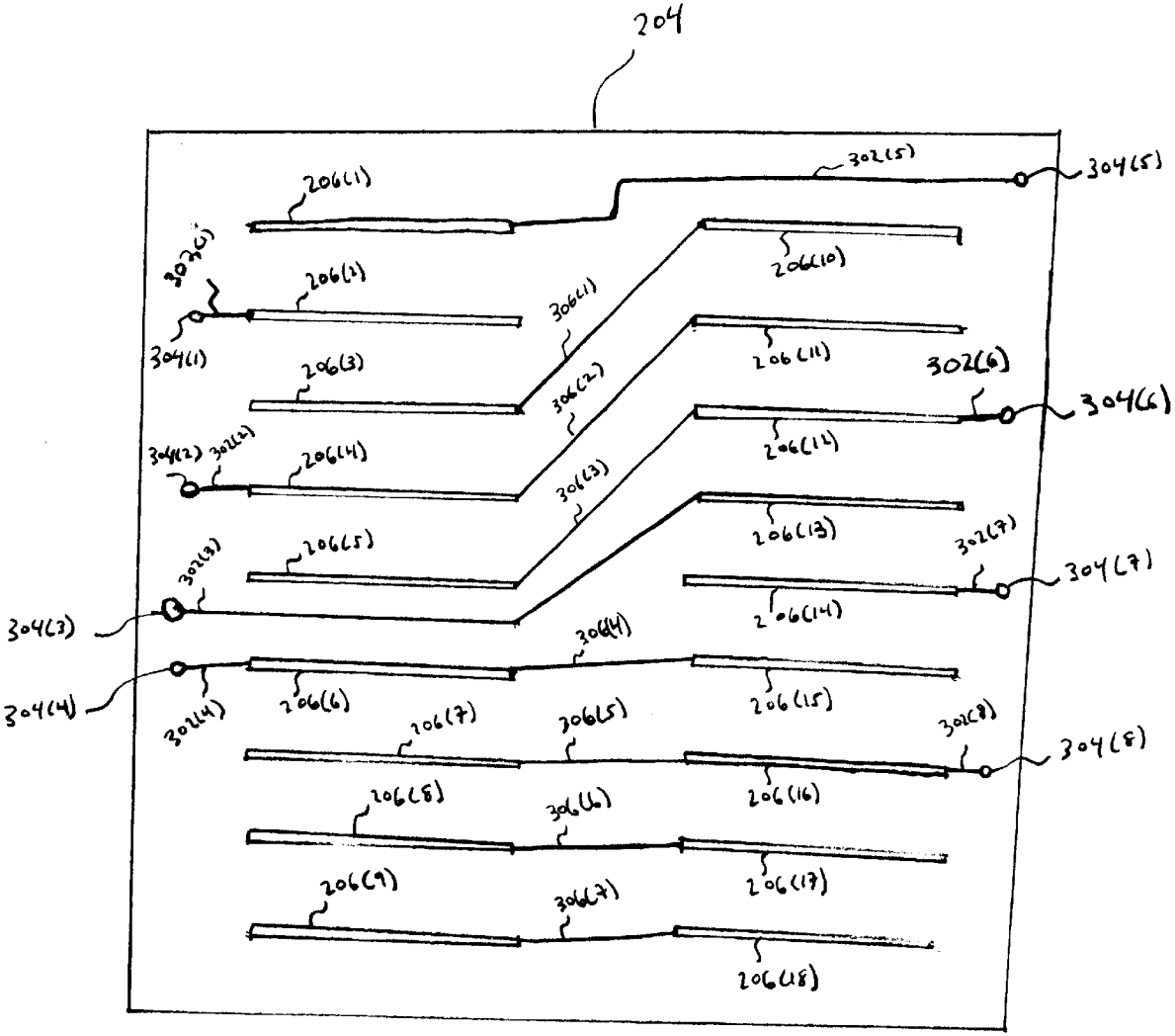
FIG. 3 is a diagram of a printed circuit board (PCB) according to one embodiment.

FIG. 3 illustrates one embodiment of PCB 204 when nine conductors 202 are used to form transformer 200. As shown in FIG. 3, PCB 204 includes eighteen slots 206(1)–(18). Each slot 206 receives an end of one of the conductors 202. For example, as shown in FIG. 2, slot 206(9) receives one end of conductor 202(9) and slot 206(1) receives the other end of conductor 202(9).

PCB 204 also includes conductive metal strips (also referred to as "traces") 302(1)–(8) and 306(l)–(7), and plated thru-holes 304(1)–(8). Traces 302(1)–(8) serve to connect a slot 206 to a thru-hole 304. Traces 306(1)–(7) serve to electrically connect a pair of slots 206. For example, trace 306(1) electrically connects slot 206(3) with slot 206(10), and trace 302(1) connects slot 206(2) with plated thru-hole 304(1). Thus, if one end of conductor 202(1) is inserted into slot 206(3) and one end of conductor 202(2) is inserted into slot 206(10), then conductor 202(1) and 202(2) are electrically connected in series by trace 306(1). Advantageously, PCB 204 is designed so that there are no trace crossovers. That is, there are no two traces that pass through the same point, which allows the utilization of all PCB layers to conduct current.

Figure 5:
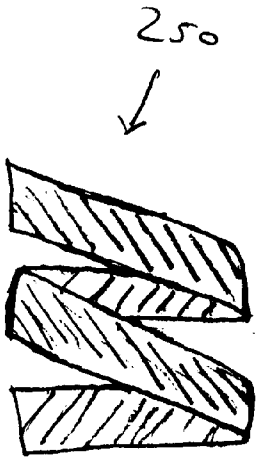
FIG. 5 shows the conductor stack being wound into the shape of a coil.
Figure 4:
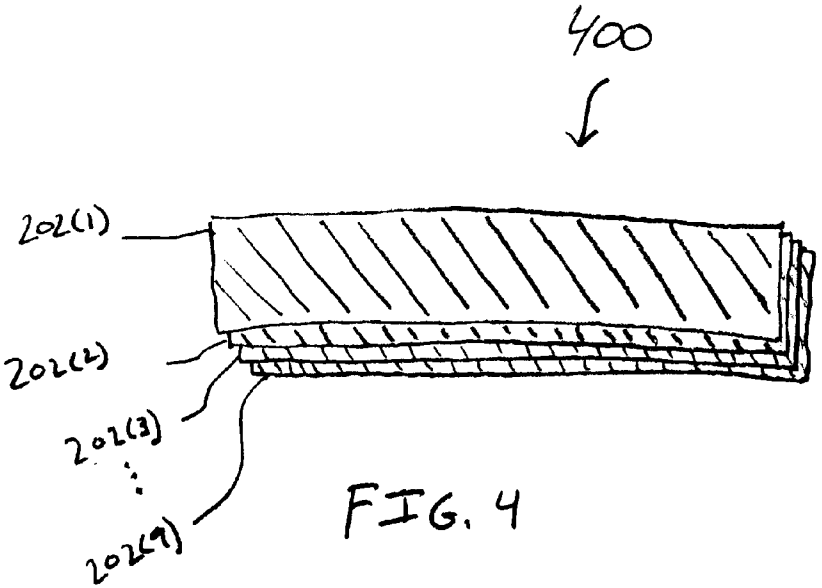
FIG. 4 is an illustration of a conductor stack.

The process of constructing transformer 200 will now be described. Transformer 200 is constructed by first stacking conductors 202 on top of each other to form a conductor stack 400, as shown in FIG. 4. Preferably, each conductor 202 is coated with (or encased within) an electrically insulating material so as to electrically insulate the conductors from each other. Next, conductor stack 400 is formed into a coil 250 (or spiral) by winding conductor stack 400 around an axis, as shown in FIG. 5. The number of times conductor stack 400 is wound around the axis depends on the application for which transformer 200 will be used. In one embodiment, conductor stack 400 is wound around the axis two times, as shown in FIG. 5.

Figure 6:
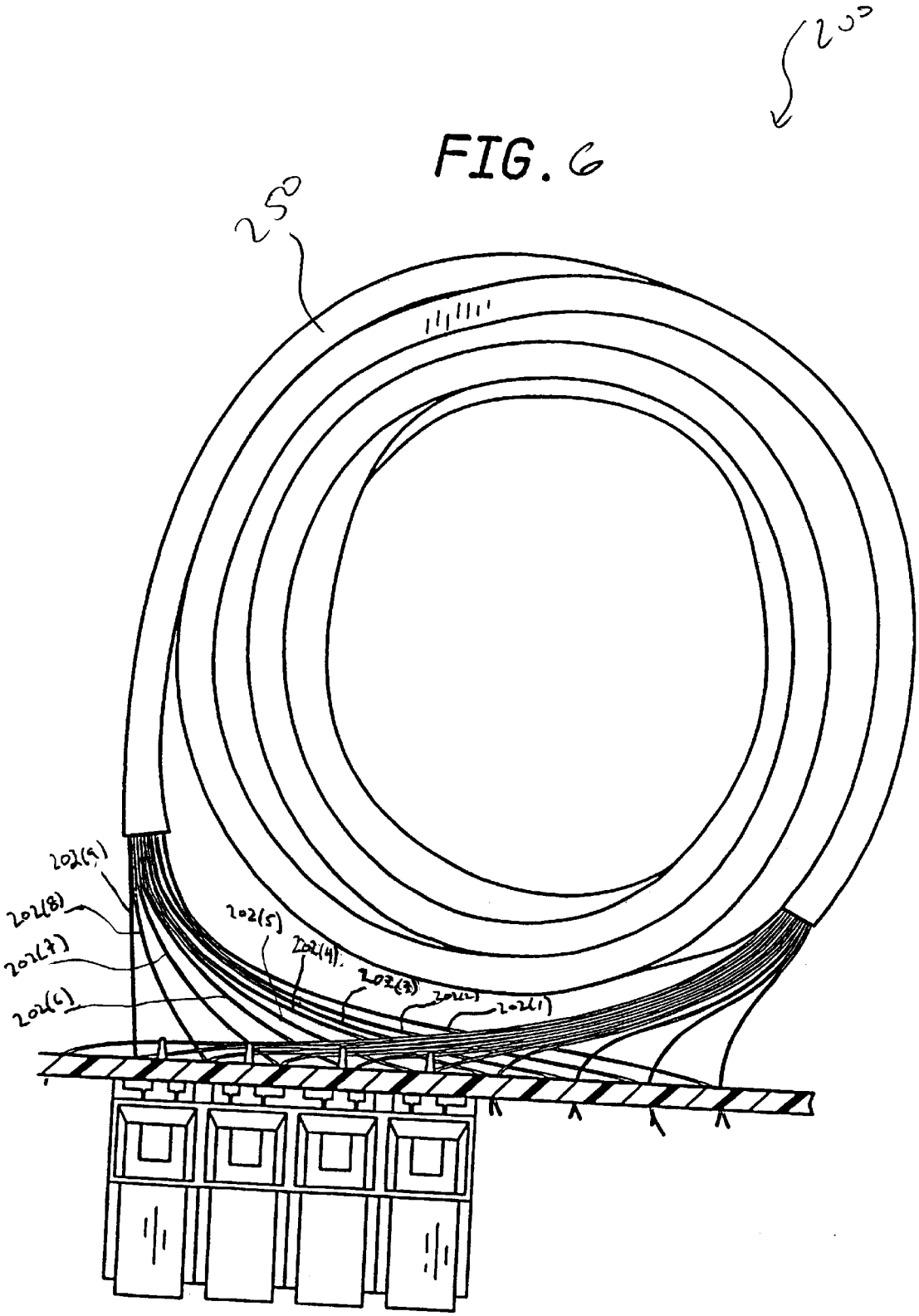
FIG. 6 is a side view of the transformer shown in FIG. 2.

After forming conductor stack 400 into the shape of a coil, each end of each conductor 202 is inserted into one of the slots 206 of PCB 204, as shown in FIG. 6. In one configuration, transformer 200 is configured as follows. Slot 206(1) receives one end of conductor 202(1) and slot 206(18) receives the other end. Slot 206(2) receives one end of conductor 202(2) and slot 206(17) receives the other end. Slot 206(3) receives one end of conductor 202(3) and slot 206(16) receives the other end. Slot 206(4) receives one end of conductor 202(4) and slot 206(15) receives the other end. Slot 206(5) receives one end of conductor 202(5) and slot 206(14) receives the other end. Slot 206(6) receives one end of conductor 202(6) and slot 206(13) receives the other end. Slot 206(7) receives one end of conductor 202(7) and slot 206(12) receives the other end. Slot 206(8) receives one end of conductor 202(8) and slot 206(11) receives the other end. Slot 206(9) receives one end of conductor 202(9) and slot 206(10) receives the other end.

The last step in the process of constructing transformer 200 is to secure each conductor 202 to PCB 204. This can be accomplished by, among other ways, soldering each end of each conductor 202 to PCB 204 so that a good electrical connection is made and the end won't slip out of the slot 206 in which it was inserted.

Figure 7:
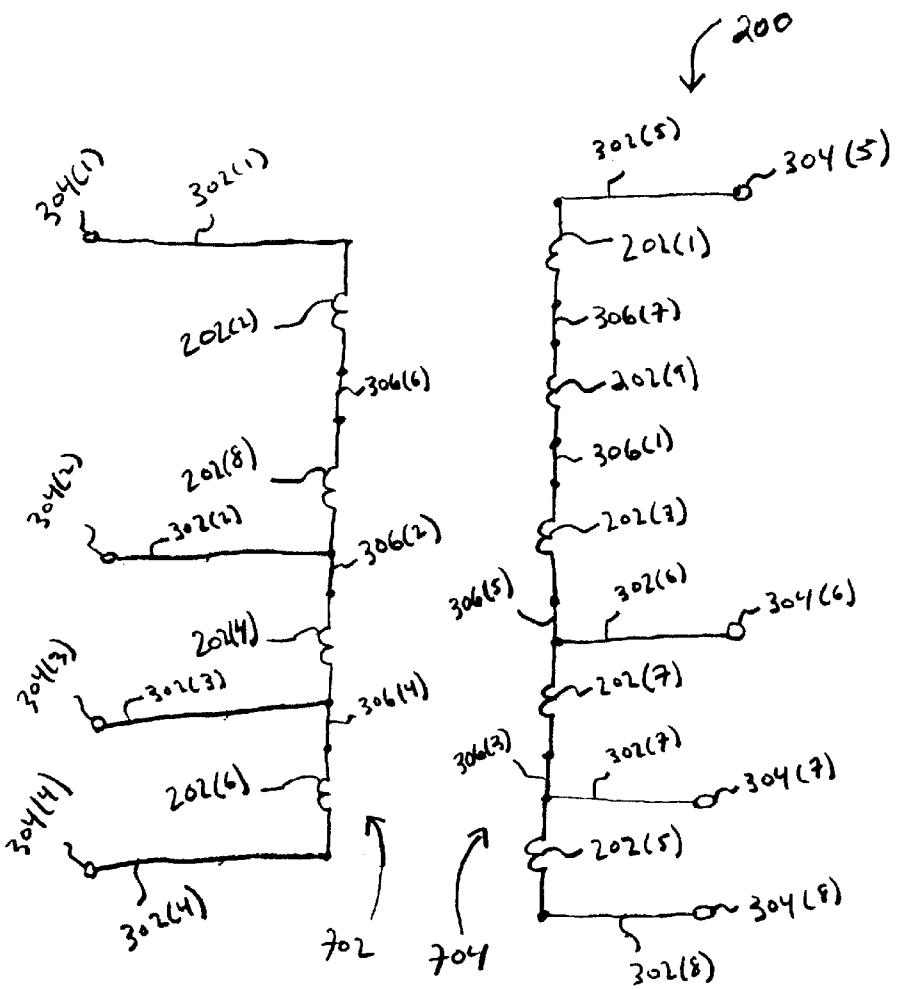
FIG. 7 is a circuit model of a transformer according to one embodiment.

FIG. 7 is an idealized circuit diagram of the transformer 200 that is formed using PCB 204 and the above described process and configuration. As shown in FIG. 7, transformer 200 includes a primary winding 702 and a secondary winding 704. The primary winding consists of conductors 206(2), 206(4), 206(6), and 206(8) and traces 306(2), 306(4) and 306(6), which connect conductors 206(2), 206(4), 206(6), and 206(8) in series. The secondary winding consists of conductors 206(1), 206(3), 206(5), 206(7), and 206(9) and traces 306(1), and 306(7), which connect conductors 206(1), 206(3), 206(5), 206(7), and 206(9) in series.

Traces 302 and thru-holes 304 (also referred to as input/output terminals) provide transformer 200 with versatility. For example, they enable transformer 200 to have a number of possible input to output voltage ratios. The possible input to output voltage ratios are: 1:1, 1:2, 1:3, 1:4, 1:5, 2:1, 2:3, 2:5, 3:1, 3:2, 3:4, 3:5, 4:1, 4:3, and 4:5. For example, to achieve a 1:1 input to output voltage ratio, the voltage input terminal pair would be input terminals 304(1) and 304(4), and the output terminal pair would be output terminals 304(5) and 304(7). Similarly, to achieve a voltage ratio of 1:3, the voltage input terminal pair would be input terminals 304(2) and 304(3), and the output terminal pair would be output terminals 304(5) and 304(6). The table below illustrates the relationship between the input terminal pairs, output terminal pairs, and the voltage ratio.

| Input/Output Voltage Ratio | Input Terminals | Output Terminals |
|---|---|---|
| 1:1 | 304(2) & 304(3) | 304(6) & 304(7) |
| 1:2 | 304(2) & 304(3) | 304(6) & 304(8) |
| 1:3 | 304(2) & 304(3) | 304(5) & 304(6) |
| 1:4 | 304(2) & 304(3) | 304(5) & 304(7) |
| 1:5 | 304(2) & 304(3) | 304(5) & 304(8) |
| 2:1 | 304(1) & 304(2) | 304(6) & 304(7) |

-continued

| Input/Output Voltage Ratio | Input Terminals | Output Terminals |
|---|---|---|
| 2:3 | 304(1) & 304(2) | 304(5) & 304(6) |
| 2:5 | 304(1) & 304(2) | 304(5) & 304(8) |
| 3:1 | 304(1) & 304(3) | 304(6) & 304(7) |
| 3:2 | 304(1) & 304(3) | 304(6) & 304(8) |
| 3:4 | 304(1) & 304(3) | 304(5) & 304(7) |
| 3:5 | 304(1) & 304(3) | 304(5) & 304(8) |
| 4:1 | 304(1) & 304(4) | 304(6) & 304(7) |
| 4:3 | 304(1) & 304(4) | 304(5) & 304(6) |
| 4:5 | 304(1) & 304(4) | 304(5) & 304(8) |

Figure 8:
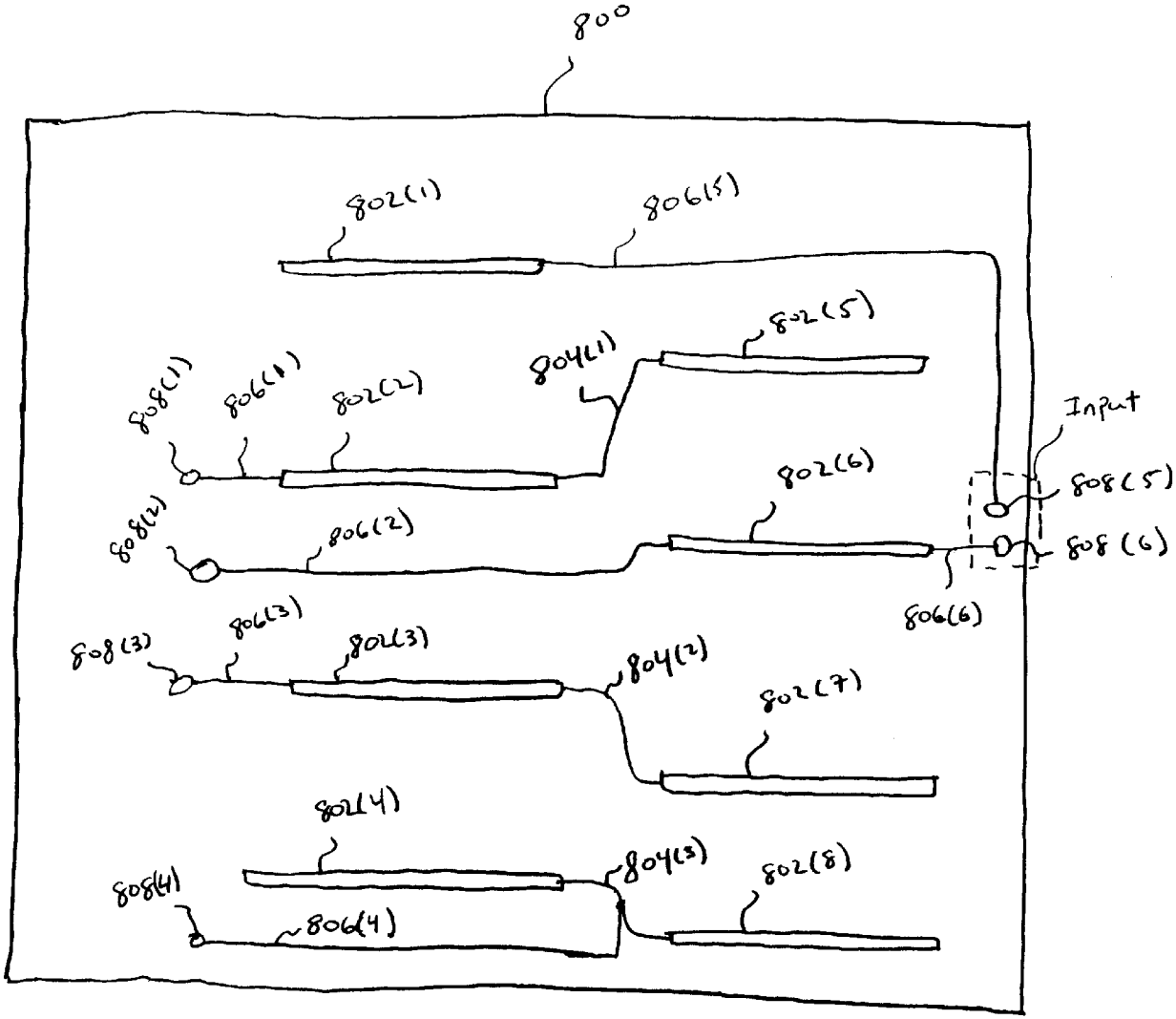
FIG. 8 is a diagram of a PCB according to one embodiment.
Figure 9:
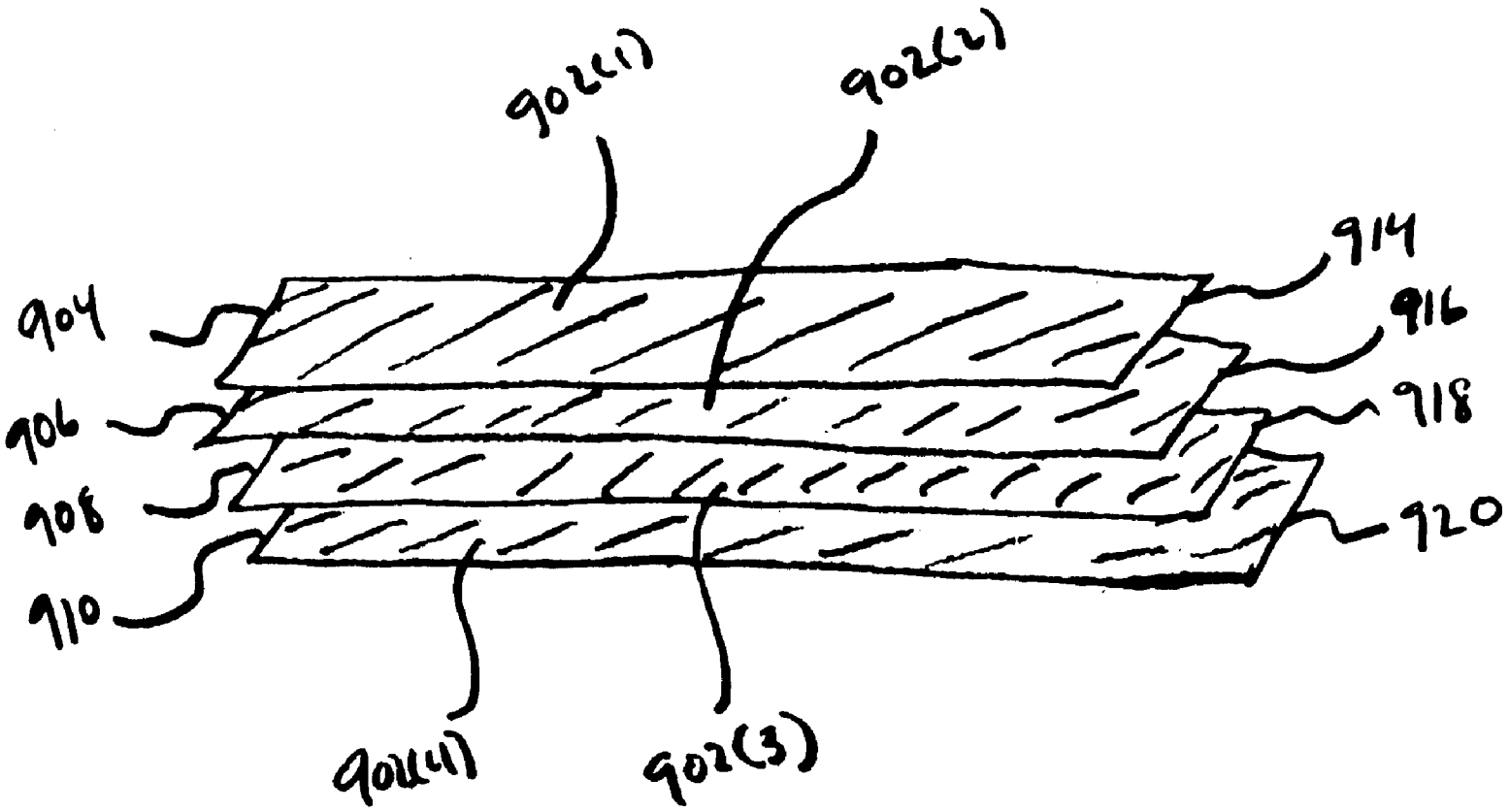
FIG. 9 is a diagram of a conductor stack.

FIG. 8 illustrates a printed circuit board (PCB) 800 according to another embodiment of the invention. PCB 800 is used to create an auto-transformer 1000 (see FIG. 10). An auto-transformer is constructed in the same way that transformer 200 is constructed. That is, a stack of conductors is wound into the shape of a coil, and each end of each conductor is electrically connected to PCB 800. For example, given the stack of conductors 902(1)–902(4) shown in FIG. 9, an auto-transformer would be constructed as follows. First the stack of conductors 902 would be wound around an axis to form a shape of a coil. Next, ends 904, 906, 908 and 910 are inserted into plated slots 802(1), 802(2), 802(3), and 802(4), respectively. And ends 914, 916 918, and 920 are inserted into plated slots 802(8), 802(7), 802(6), and 802(5), respectively.

Figure 10:
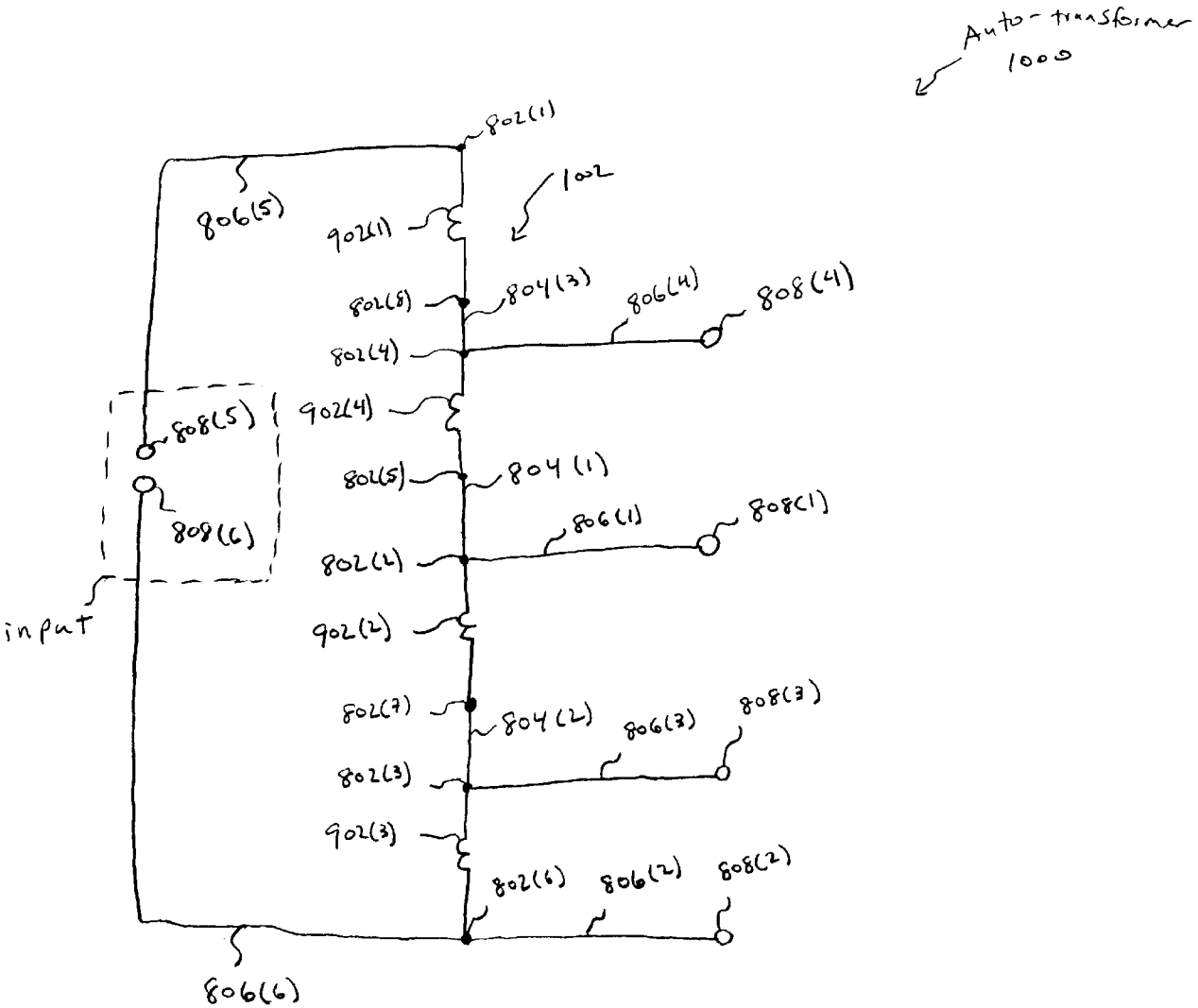
FIG. 10 is a circuit diagram of an auto-transformer according to one embodiment.

FIG. 10 illustrates the resulting auto-transformer 1000. As shown in FIG. 10, auto-transformer 1000 comprises a winding 1002 consisting of conductors 902(1)–902(4) and traces 804(1)–804(3) connected in series. The Auto-transformer also includes input terminals 808(5) and 808(6) connected to winding 1002 via traces 806(5) and 806(6), and a number of output terminals 808(1)–808(4) connected to winding 1002 via traces 806(1)–806(4).

Figure 11:
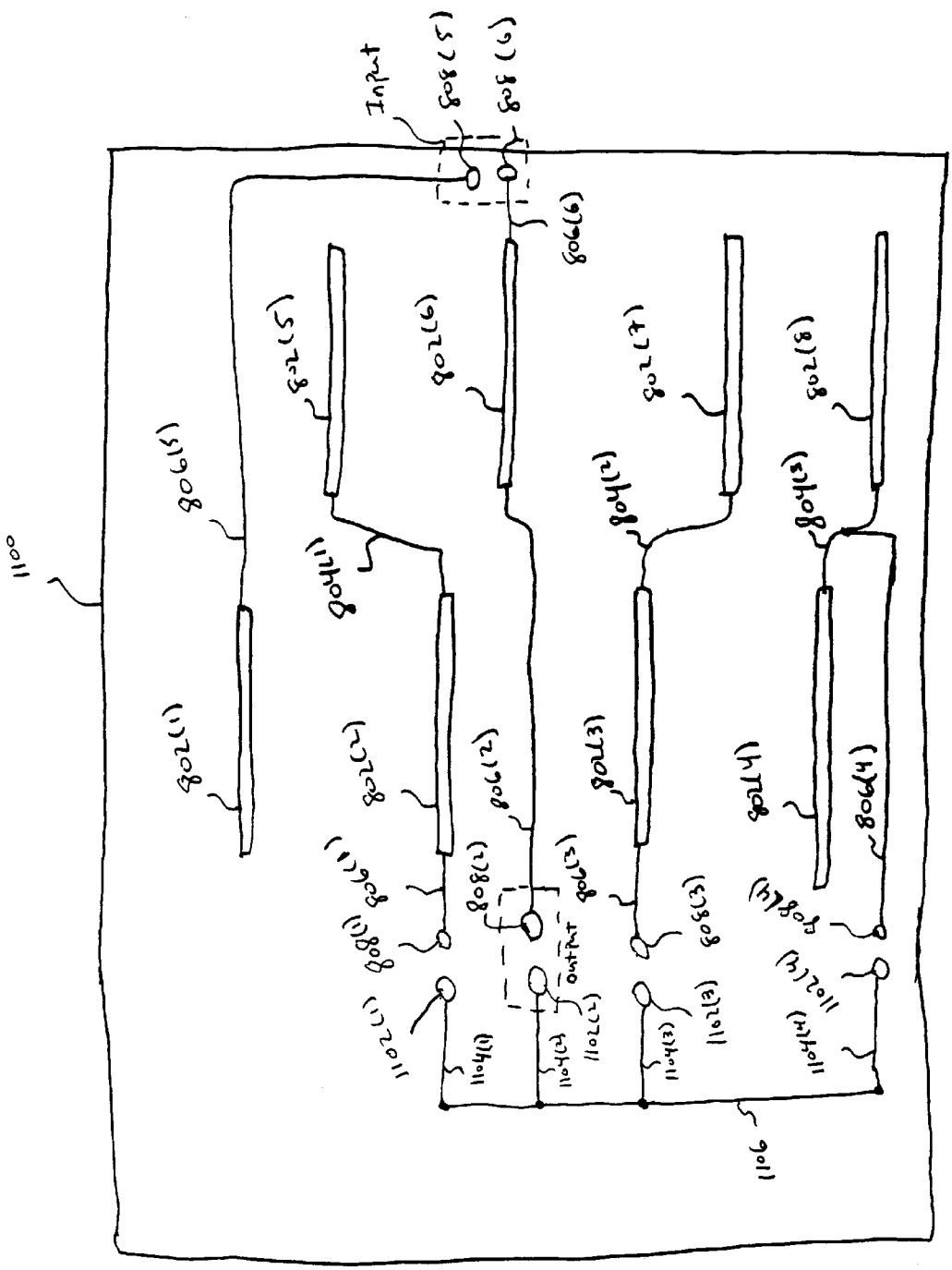
FIG. 11 is a diagram of a PCB for creating an auto-transformer.
Figure 12:
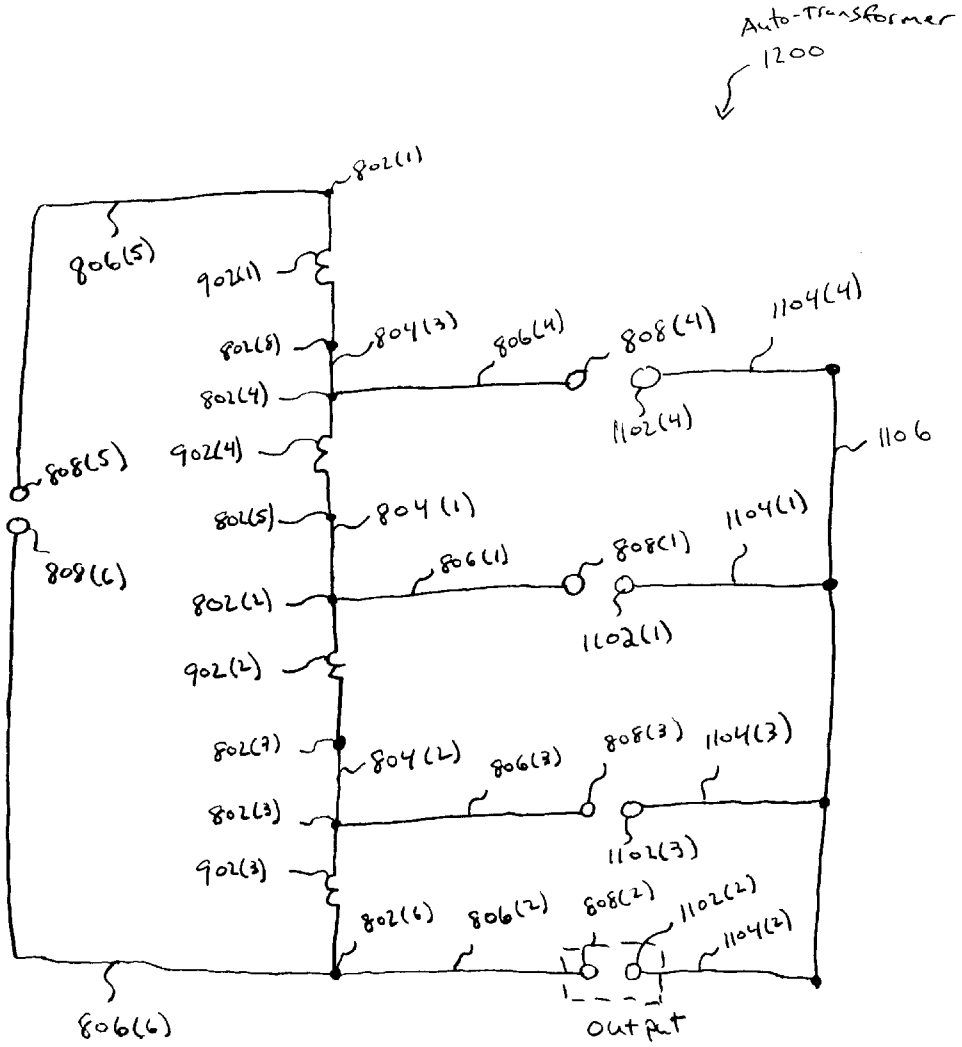
FIG. 12 is a circuit diagram of an auto-transformer created using the PCB illustrated in FIG. 11.

FIG. 11 illustrates a PCB 1100, which is identical to PCB 800 with the exception that PCB 1100 additionally includes traces 1104(1)–(4) and 1106 and through holes 1102(1)–(4). Like PCB 800, PCB 1100 is used to create an auto-transformer 1200 (see FIG. 12). Auto-transformer 1200 is created in the same manner as auto-transformer 1000. The difference between auto-transformer 1000 and 1200, is that it is easier to set and change the input/output ratio of auto-transformer 1200. That is, in auto-transformer 1200 the input/output voltage ratio is determined simply by using a jumper (not shown), or the like, to electrically connect one of the through hole pairs 808(4)&1102(4), 808(1)&1102(1), or 808(3)&1102(3).

While various embodiments/variations of the present invention have been described above, it should be understood that they have been presented by way of example only, and not limitation. Thus, the breadth and scope of the present invention should not be limited by any of the above-described exemplary embodiments, but should be defined only in accordance with the following claims and their equivalents.

What is claimed is:

1. A transformer, comprising:

a plurality of conductors stacked on top of each other, thereby forming a conductor stack, the conductor stack being wound, at least once, around an axis, thereby forming a coil, wherein each of said plurality conductors has a first end and a second end; and a printed circuit board (PCB) comprising a plurality of traces, wherein said first end and said second end of each of said plurality of conductors is connected to said PCB and electrically coupled to at least one of said traces.

2. The transformer of claim 1, wherein a first subset of said plurality of conductors and a first subset of said plurality of traces form a primary winding of the transformer, and a second subset of said plurality of conductors and a second subset of said traces form a secondary winding of the transformer.

3. The transformer of claim 2, wherein the PCB comprises means for enabling the transformer to have more than one input to output voltage ratio.

4. The transformer of claim 1, wherein each of said conductors is made substantially from litz wire.

5. The transformer of claim 1, wherein the conductor stack is wound, at least twice, around the axis.

6. The transformer of claim 2, wherein the conductors that make up said first subset of conductors are interleaved in said conductor stack with the conductors that make up said second subset of conductors.

7. The transformer of claim 2, wherein said first subset of traces are used to connect said first subset of conductors in series, and said second subset of traces are used to connect said second subset of conductors in series.

8. The transformer of claim 1, wherein said PCB comprises a plurality of plated slots, each of said plurality of plated slots receiving one end of one of said plurality of conductors.

9. The transformer of claim 8, wherein each of said plurality of slots is connected to at least one of said plurality of traces.

10. The transformer of claim 1, wherein each of said plurality of conductors is a thin strip of an electrically conductive material.

11. The transformer of claim 10, wherein said material is copper.

12. The transformer of claim 1, wherein the transformer is an auto-transformer having a single winding and said plurality of conductors and said plurality of traces form said single winding, and wherein said plurality of traces are used to connect said conductors in series.

13. A transformer, comprising:

a printed circuit board (PCB) comprising a first trace and a second trace;

a primary winding; and a secondary winding, wherein said primary winding comprises said first trace, a first electrically conducting element, and a second electrically conducting element, wherein said first trace electrically connects one end of said first electrically conducting element to one end of said second electrically conducting element, said primary winding comprises said second trace, a third electrically conducting element, and a fourth electrically conducting element, wherein said second trace electrically connects one end of said third electrically conducting element to one end of said fourth electrically conducting element, said electrically conducting elements are stacked on top of each other, thereby forming a stack of electrically conducting elements, such that said third electrically conducting element is disposed between said first and said second electrically conducting elements and said second electrically conducting element is disposed between said third and said fourth electrically conducting elements, and said stack of electrically conducting elements is wound, at least once, around an axis.

14. The transformer of claim 13, wherein each of said electrically conducting elements is coated with or encased within an electrically insulating material.

15. The transformer of claim 13, wherein each of said electrically conducting elements comprises a thin, elongated strip of copper.

16. The transformer of claim 15, wherein said copper strip has a width of greater than about 1 inch and less than about 2 inches.

17. The transformer of claim 13, wherein said PCB comprises at least eight slots, wherein each of said slots receives, at least, one end of one of the electrically conducting strips.

18. The transformer of claim 13, wherein the PCB comprises means for enabling the transformer to have more than one input to output voltage ratio.

19. The transformer of claim 13, wherein said stack of electrically conducting elements is wound, at least twice, around said axis.

20. The transformer of claim 13, wherein each of said electrically conducting elements comprises litz wire.

* * * * *